US005887535A

United States Patent [19]

Yu

[11] Patent Number: 5,887,535

[45] Date of Patent: Mar. 30, 1999

[54] THREAD CUTTING DEVICE FOR A SEWING MACHINE

[76] Inventor: Ming-Tung Yu, No. 4, Hsiu-Wu St., San-Min Dist., Kaohsiung City, Taiwan

[21] Appl. No.: 126,500

[22] Filed: Jul. 30, 1998

[51] Int. Cl.[6] ..... D05B 65/00

[52] U.S. Cl. ..... 112/298

[58] Field of Search ..... 112/296, 298, 112/292, 285, 288, 291, 293, 300, 295

[56] References Cited

U.S. PATENT DOCUMENTS

| | | | |
|---|---|---|---|
| 5,125,351 | 6/1992 | Prais et al. | 112/292 |
| 5,469,798 | 11/1995 | Gauch | 112/298 |
| 5,481,994 | 1/1996 | Ku | 112/298 |

*Primary Examiner*—Peter Nerbun

*Attorney, Agent, or Firm*—Ladas & Parry

[57] ABSTRACT

A thread cutting device for a sewing machine includes a horizontal base plate, an elongated horizontal feed plate and an elongated horizontal cutting plate. A driving rod is mounted pivotally on the base plate, and can be swung by a driving unit to swing the feed plate and the cutting plate on the base plate. When the feed plate moves forward toward a thread-engaging needle, a projection of the feed plate contacts a fixed stop member of the base plate so as to prevent further forward movement of the feed plate, thereby permitting forward movement of the cutting plate relative to the feed plate. At this time, the cutting plate is guided to move to a front limit position in a direction parallel to the needle. In this way, when the cutter is driven by the driving unit to move rearward from the front limit position, a row of threads can be effectively cut off by the cutter.

4 Claims, 5 Drawing Sheets

THREAD CUTTING DEVICE FOR A SEWING MACHINE

BACKGROUND OF THE INVENTION

1. Field of the Invention

This invention relates to a thread cutting device for a sewing machine, more particularly to a thread cutting device for cutting threads accurately.

2. Description of the Related Art

Referring to FIG. 1, a conventional thread cutting device for a sewing machine is shown to include a machine bed 1, a movable assembly 2, a thread-engaging needle 8, and a driving unit 9, such as a motor. The needle 8 is in front of the movable assembly 2. The machine bed 1 has a horizontal base plate 11, a driving rod 12 and a fixed stop member 13. The driving rod 12 is mounted pivotally on the base plate 11, and has a first end 121 connected pivotally to a shaft 91 of the driving unit 9, and a rounded second end 122. The movable assembly 2 includes an elongated horizontal feed plate 21, an elongated horizontal cutting plate 22 with a fixed cutter 23, a front crank 24, and a rear crank 25. The feed plate 21 is mounted slidably on a top surface of the base plate 11, and has a transversely extending projection 211. The horizontal cutting plate 22 is in friction contact with a top surface of the feed plate 21, and has a front longitudinal slide slot 221, a rear longitudinal slide slot 222, and an open-ended transverse slide slot 223. The cutter 23 is disposed at a front end of the cutting plate 22, and has two bladed barbs 231, 232. The front crank 24 has a pivot end 241 pivoted to the base plate 11, and a crankpin 242, which is received slidably within the front longitudinal slide slot 221 in the cutting plate 22. Similarly, the rear crank 25 has a pivot end 251 pivoted to the base plate 11, and a crankpin 252, which is received slidably within the front longitudinal slide slot 222 in the cutting plate 22. The rounded second end 122 of the driving rod 12 is received slidably within the transverse slide slot 223 in the cutting plate 22. Accordingly, when the driving rod 12 is swung by the driving unit 9, the second end 122 of the driving rod 12 pushes the cutting plate 22 to reciprocate on the base plate 11 along a curved path. At this time, the feed plate 21 is swung with the cutting plate 22 due to frictional contact therebetween. When the movable assembly 2 moves toward the thread-engaging needle 8, the projection 211 of the feed plate 21 will contact the stop member 13 of the base plate 11, thereby preventing further forward movement of the feed plate 21 on the base plate 11. Then, only the cutting plate 22 is pushed forward by the rounded second end 122 of the driving rod 12, thereby moving the cutter 23 to a front limit position indicated by the phantom lines along a curved path. As such, when moved rearward from the front limit position along the curved path, it is likely that the bladed barbs 231, 232 of the cutter 23 cannot engage a row of three threads 81 to be cut, which are located on one side of the needle 8. Accordingly, it is difficult for the cutter 23 to cut off all of the three threads 81.

SUMMARY OF THE INVENTION

The object of this invention is to provide a thread cutting device for a sewing machine which can ensure that all of the threads on the sewing machine can be cut.

According to this invention, a thread cutting device for a sewing machine includes a horizontal base plate, an elongated horizontal feed plate and an elongated horizontal cutting plate. A driving rod is mounted pivotally on the base plate, and can be swung by a driving unit to swing the feed plate and the cutting plate on the base plate. When the feed plate moves forward toward a thread-engaging needle, a projection of the feed plate contacts a fixed stop member of the base plate so as to prevent further forward movement of the feed plate, thereby permitting forward movement of the cutting plate relative to the feed plate. At this time, the cutting plate is guided to a front limit position in a direction parallel to the needle. In this way, when the cutter is driven by the driving unit to move rearward from the front limit position, a row of threads can be effectively cut off by the cutter.

BRIEF DESCRIPTION OF THE DRAWINGS

Other features and advantages of this invention will become apparent in the following detailed description of the preferred embodiment of this invention, with reference to the accompanying drawing, in which.

DETAILED DESCRIPTION OF THE PREFERRED EMBODIMENT

Figure 1:
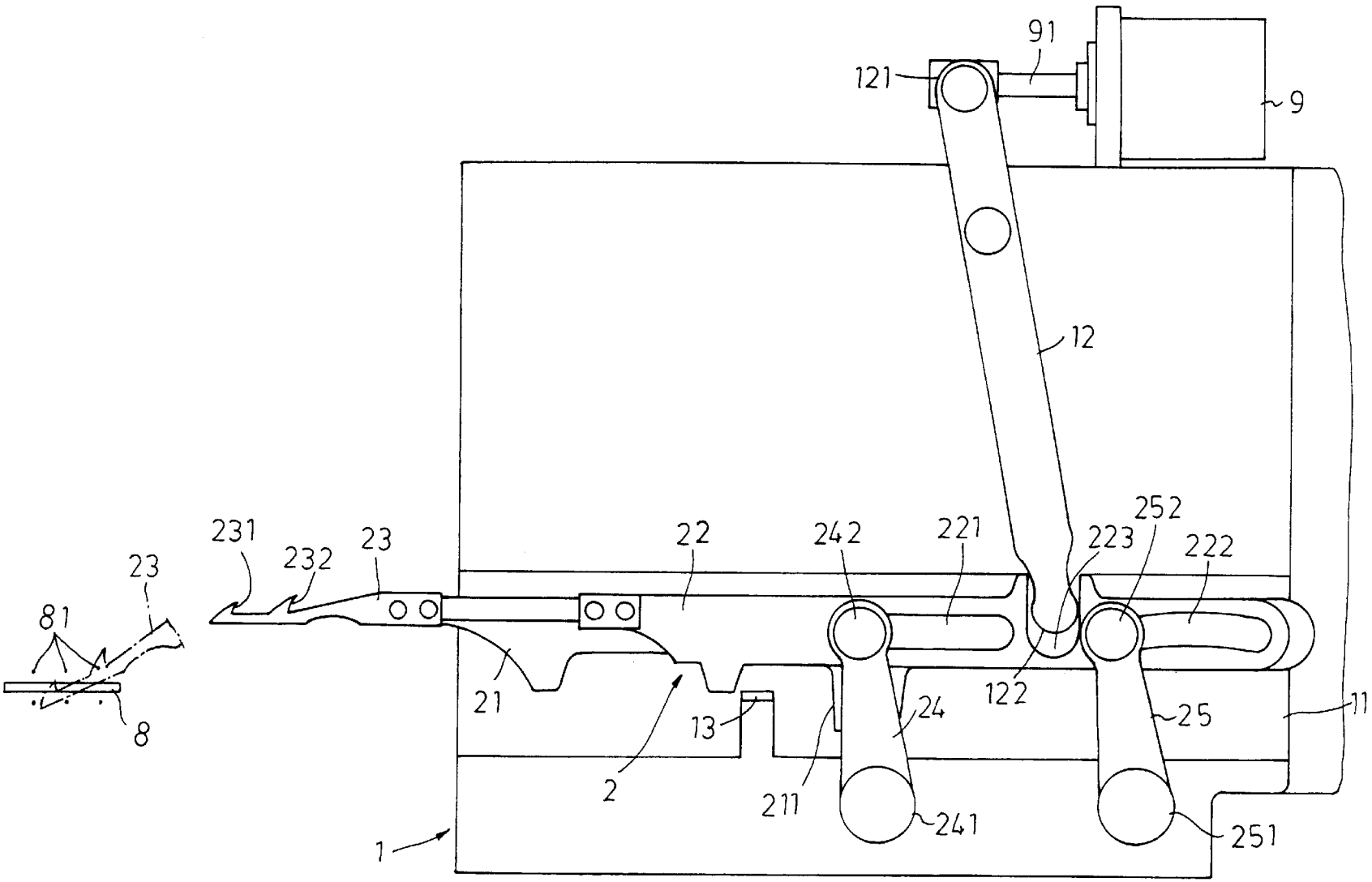
FIG. 1 PRIOR ART
FIG. 1 is a schematic top view illustrating a conventional thread cutting device for a sewing machine.
Figure 2:
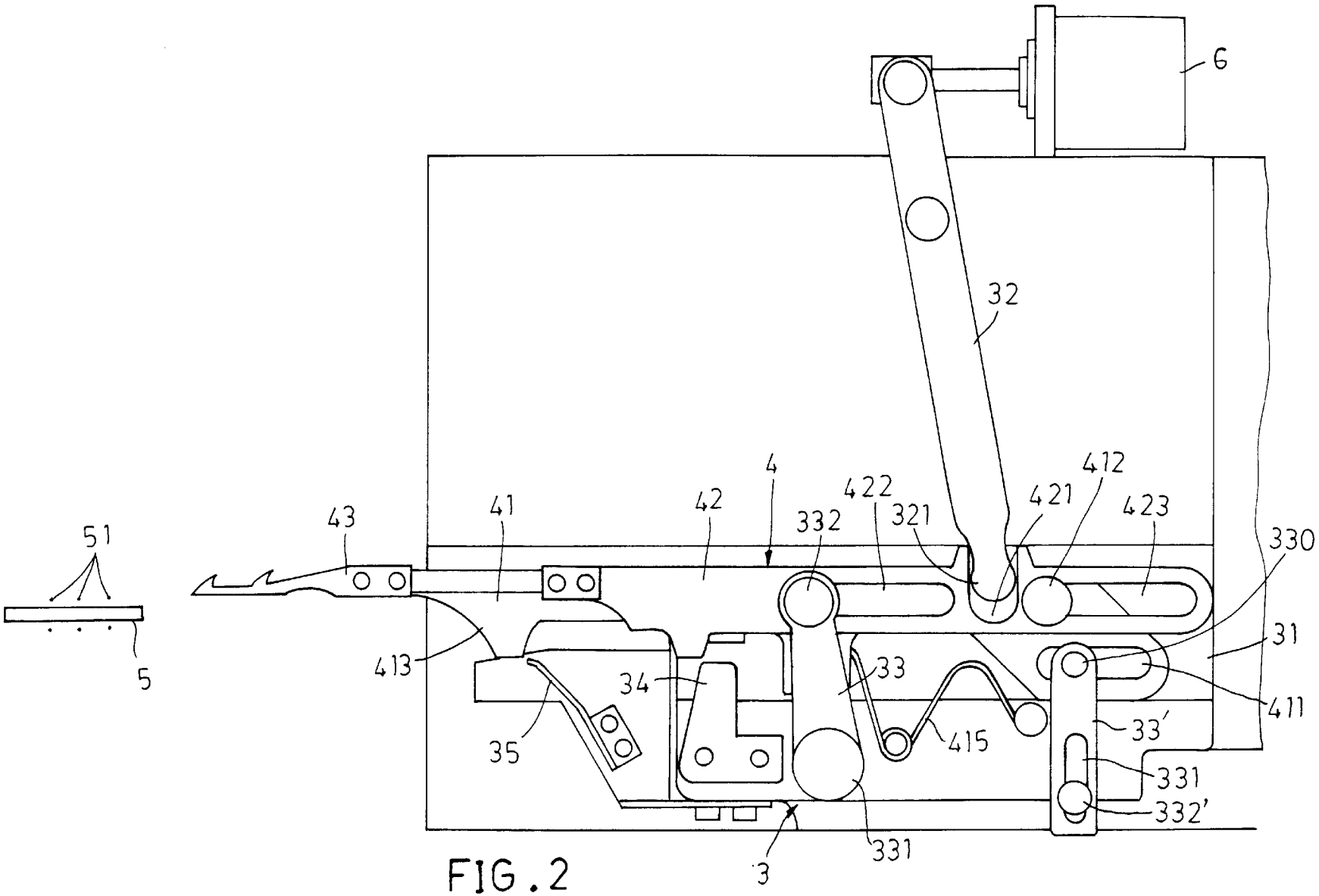
FIG. 2 is a schematic top view illustrating the preferred embodiment of a thread cutting device for a sewing machine according to this invention, in which a cutter is at a rear limit position.

Referring to FIG. 2, the preferred embodiment of a thread cutting device for a sewing machine according to this invention is shown to include a machine bed 3 with a horizontal base plate 31, and a movable assembly 4. A thread-engaging needle 5 is in front of the movable assembly 4.

The movable assembly 4 includes an elongated horizontal feed plate 41 mounted slidably on a top surface of the base plate 31 in a known manner, and an elongated horizontal cutter 42 in frictional contact with a top surface of the feed plate 41. As such, the feed plate 41 can slide with the cutting plate 42 on the base plate 31.

The feed plate 41 has a short longitudinal slide slot 411, a fixed sliding member 412, a transversely extending front projection 413 and a transversely extending rear projection 414. The cutting plate 42 has a transverse slide slot 421, a front longitudinal slide slot 422 and a rear longitudinal slide slot 423. As illustrated, the slots 411, 422, 423 are all straight, and extend in a direction generally parallel to the needle 5. The front longitudinal slide slot 422 is aligned with and is located in front of the rear longitudinal slide slot 423. The short longitudinal slide slot 411 is formed through a rear end portion of the feed plate 41, and is located near the rear longitudinal slide slot 423 in the cutting plate 42. The transverse slide slot 421 is located between the front and rear longitudinal slide slots 422, 423, and extends in a direction generally perpendicular to that of the front and rear longitudinal slide slots 422, 423. The sliding member 412 of the feed plate 41 is received slidably within the rear longitudinal slide slot 423, thereby guiding the cutting plate 42 to move on the feed plate 41 in a direction generally parallel to the needle 5.

A driving rod 32 is mounted pivotally on the base plate 31, and has a rounded end 321, which is received slidably within the transverse slide slot 421 in the cutting plate 42.

A crank 33 has a pivot end 331 which is mounted pivotally on the base plate 31, and a crankpin 332, which is received slidably within the front longitudinal slide slot 422 in the cutting plate 42.

A straight, horizontal adjustment rod 33' is disposed behind the crank 33, and is generally parallel to the needle 5. A vertical pin 412 is secured to the adjustment rod 33', and is received slidably within the short longitudinal slide slot 411 in the feed plate 41, thereby retaining the adjustment rod 33' on the feed plate 41. The adjustment rod 33' has a slide slot 331, which is formed therethrough and which is generally perpendicular to the needle 5.

A lock bolt 332' extends through the slide slot 331 in the adjustment rod 33' to lock the adjustment rod 33' on the base plate 31. When the lock bolt 332' is loosened from the adjustment rod 33', the adjustment rod 33' can carry the feed plate 41 to move on the base plate 31 in a direction parallel to the slide slot 331.

Figure 4:
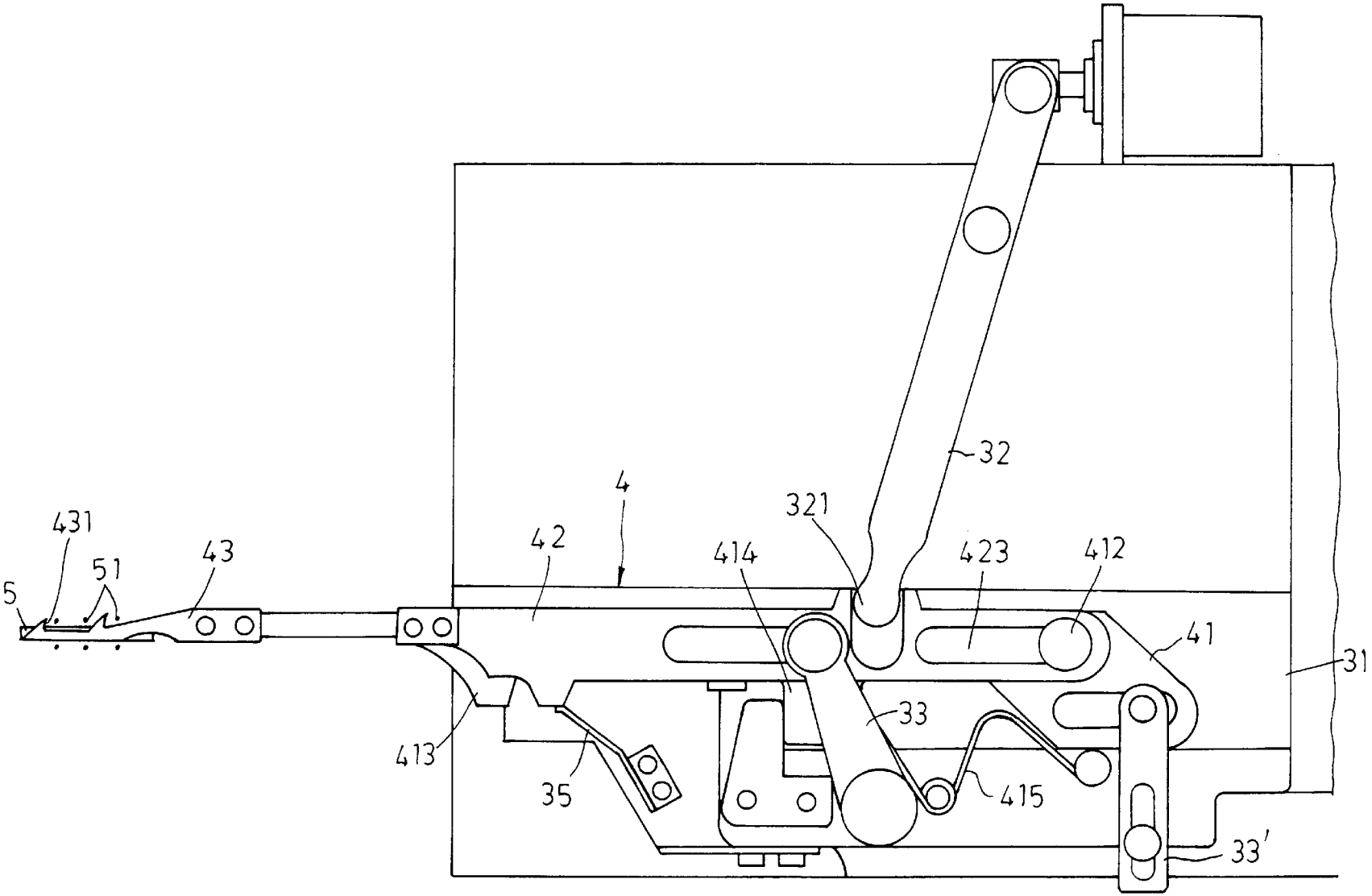
FIG. 4 is a schematic top view illustrating the preferred embodiment in which the cutter is at a front limit position.

In operation, the driving unit 6 can swing the driving rod 32 about a vertical axis in a known manner. Swinging movement of the driving rod 32 results in reciprocating movement of the feed plate 41 and the cutting plate 42 on the base plate 31, thereby moving the feed plate 41 and the cutting plate 42 toward and away from the needle 5. Accordingly, the cutter 43 can be moved between a rear limit position shown in FIG. 2 and a front limit position shown in FIG. 4. When the cutter 43 is at the rear limit position, the sliding member 412 of the feed plate 41 is located in a front end of the rear longitudinal slide slot 423 in the cutting plate 42. As shown in FIG. 4, when the cutter 43 is at the front limit position, the sliding member 412 of the feed plate 41 is located in a rear end of the rear longitudinal slide slot 423 in the cutting plate 42.

Figure 3:
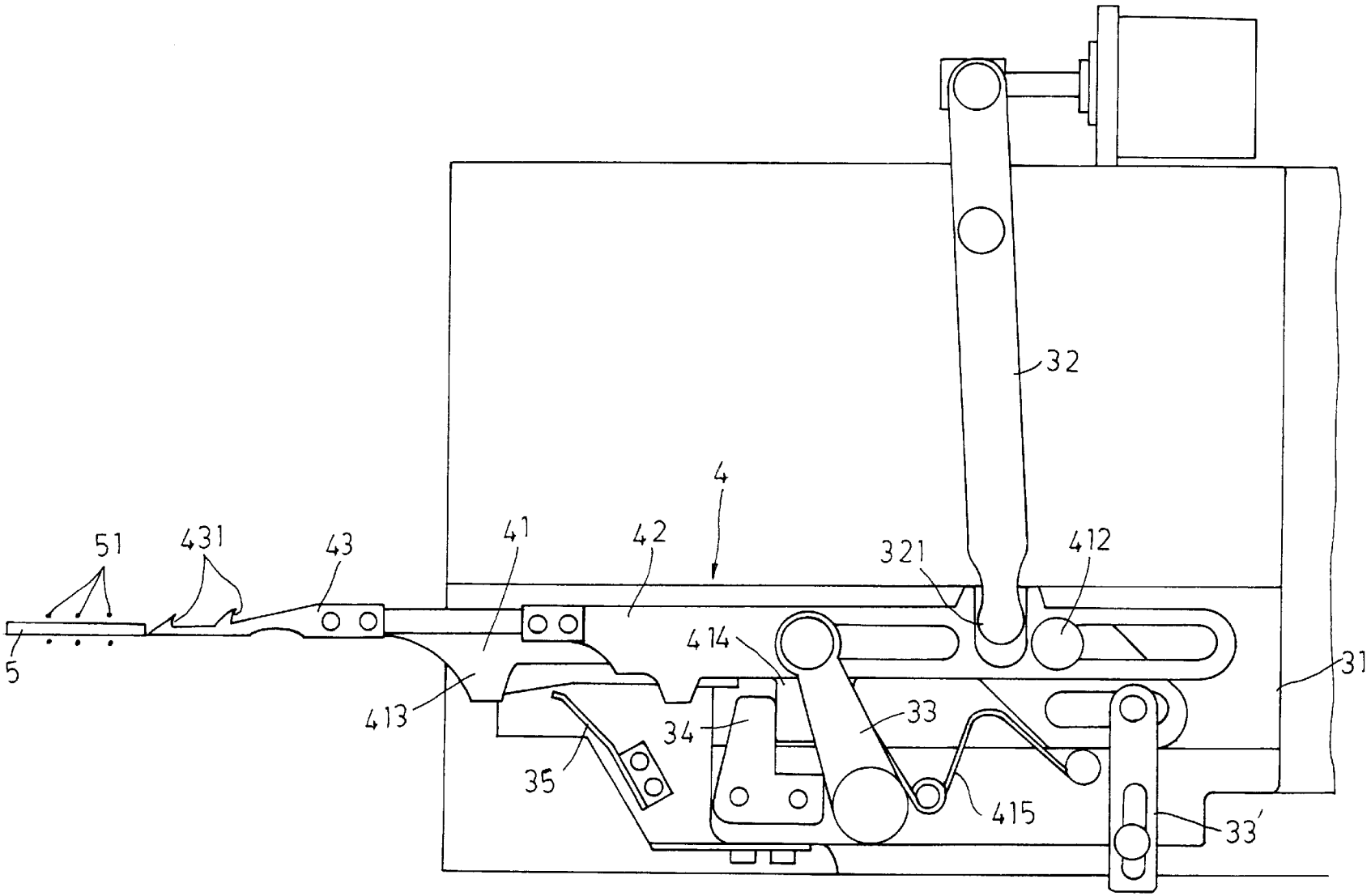
FIG. 3 is a schematic top view illustrating the preferred embodiment in which the cutter is at a stand-by position.

During forward movement of the feed plate 41 and the cutting plate 42, the cutter 43 can move from the rear limit position shown in FIG. 2 to a stand-by position shown in FIG. 3 along a curved path with the assistance of a torsion spring 415. The torsion spring 415 interconnects the feed plate 41 and the base plate 31 for biasing the feed plate 41 forward on the base plate 31.

As shown in FIG. 31 when the cutter 43 is at the standby position, the rear projection 414 of the feed plate 41 contacts the stop member 34 of the base plate 31, thereby preventing further forward movement of the feed plate 41 on the base plate 31. In addition, the front end of the cutter 43 engages an end of the needle 5. In this case, the cutter 43 is aligned with and is located immediately over the needle 5, and two bladed barbs 431 of the cutter 43 are aligned with a row of three threads 51 to be cut, which are located on one side of the needle 5. When the rounded end 321 of the driving rod 32 continues to push the cutting plate 42 forward, the cutting plate 42 moves forward relative to the feed plate 41. As such, the cutter 43 moves over the needle 5 to the front limit position in a direction parallel to the needle 5.

Figure 5:
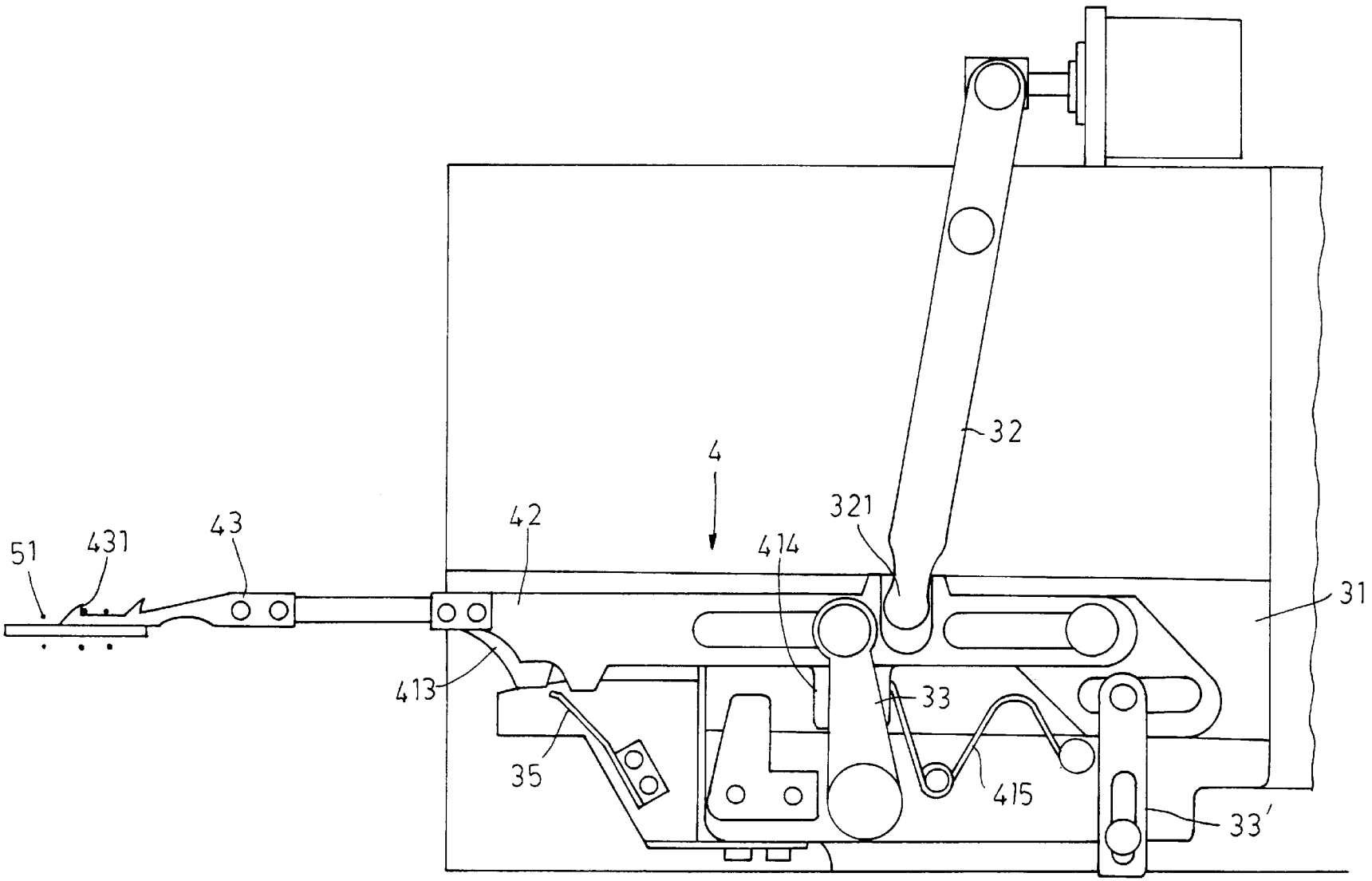
FIG. 5 is a schematic top view illustrating how the cutter of the preferred embodiment performs a thread cutting action.

Referring to FIGS. 4 and 5, when the cutter 43 moves rearward from the front limit position, a reed spring 35, which is fixed on the base plate 31, pushes the bladed barbs 431 of the cutter 43 transversely to engage and cut all of the three threads 51 in sequence.

After repair or maintenance of the movable assembly 4, to place all the elements of the assembly 4 in their correct positions, the rear projection 414 is brought first into contact with the stop member 34 of the base plate 31. Then, the front end of the cutter 43 is moved to engage the end of the needle 5 by adjusting the position of the adjustment rod 33' in a direction generally transverse to the length of the cutting plate 42.

With this invention thus explained, it is apparent that numerous modifications and variations can be made without departing the scope and spirit of this invention. It is therefore intended that this invention be limited only as indicated in the appended claims.

I claim:

1. A thread cutting device for a sewing machine, the sewing machine including a horizontal thread-engaging needle, which is in front of said thread cutting device, said thread cutting device being adapted to cut a row of threads, which are located on one side of the needle, and comprising:

a horizontal base plate having a fixed stop member thereon;

an elongated horizontal feed plate mounted slidably on a top surface of said base plate and formed with a fixed sliding member, and a transversely extending integral rear projection;

an elongated horizontal cutting plate in frictional contact with a top surface of said feed plate, thereby permitting sliding movement of said cutting plate with said feed plate on said base plate, said cutting plate and said feed plate being mounted on said base plate such that said cutting plate and said feed plate are able to reciprocate on said base plate, said cutting plate having a straight front longitudinal slide slot, a straight rear longitudinal slide slot located behind said front longitudinal slide slot and receiving slidably said sliding member therein, and an open-ended straight transverse slide slot, said front and rear longitudinal slide slots extending in a direction generally perpendicular to that of said transverse slide slot and being adapted to be disposed generally parallel to the needle, said cutting plate further including a fixed and elongated cutter at a front end thereof, said cutter being adapted to be disposed generally parallel to the needle and having a bladed barb, which is adapted to cut the threads during rearward movement thereof on said base plate;

a driving rod mounted pivotally on said base plate and having a rounded end, which is received slidably within said transverse slide slot in said cutting plate, said driving rod being capable of rotating about a vertical axis so that swinging movement of said driving rod results in reciprocating movement of said cutting plate and said feed plate on said base plate, thereby moving said cutting plate and said feed plate toward and away from the needle;

a driving unit for activating said driving rod to swing on said base plate; and a crank having a pivot end which is mounted pivotally on said base plate, and a crankpin which is received slidably within said front longitudinal slide slot in said cutting plate, said driving rod being capable of swinging on said base plate about a vertical axis, thereby moving said cutter toward and away from the needle between a front limit position and a rear limit position when said driving unit is activated, said rear projection of said feed plate being capable of contacting said stop member of said base plate during forward movement of said cutting plate and said feed plate toward the needle, thereby preventing further forward movement of said feed plate on said base plate, so as to permit sliding movement of said sliding member within said rear longitudinal slide slot in said cutting plate, engagement of said rear projection of said feed plate with said stop member of said base plate locating said cutter at a stand-by position in which said cutter is adapted to be aligned with and located immediately above the needle and in which said bladed barb of said cutter is adapted to be aligned with the threads while a front end of said cutter engages an end of the needle, thereby permitting sliding movement of said cutting plate relative to said feed plate and over the needle along a straight path during subsequent swinging movement of said driving rod.

2. A thread cutting device as claimed in claim 1, wherein said feed plate has a rear end portion with a short longitudinal slide slot formed therethrough, said device further including a straight adjustment rod and a lock bolt, said adjustment rod being adapted to be disposed generally parallel to the needle and having a fixed vertical pin, which is received slidably within said short longitudinal slide slot, and a slide slot, which is formed therethrough and which is adapted to be disposed generally perpendicular to the needle, said lock bolt extending through said slide slot in said adjustment rod to lock said adjustment rod on said base plate and being capable of being loosened from said adjustment rod, thereby permitting movement of said adjustment rod on said base plate in a direction generally transverse to the length of said cutting plate, whereby, in a situation where said cutter cannot be moved to said stand-by position, when said rear projection of said feed plate is moved to contact said stop member of said base plate, said adjustment rod can be moved in a direction generally transverse to said cutting plate on said base plate by operating said lock bolt so as to move said cutter to said stand-by position for performing a thread cutting action.

3. A thread cutting device as claimed in claim 1, wherein said feed plate further has a transversely extending front projection, which extends integrally therefrom and which is in front of said rear projection, said base plate further including a fixed reed spring, said reed spring and said driving rod being located on two sides of said cutting plate, said reed spring being positioned so as to be adapted to push said bladed barb to engage the threads to be cut when said cutter is moved rearward from said front limit position, thereby assisting said bladed barb in cutting the threads.

4. A thread cutting device as claimed in claim 1, further comprising a torsion spring which interconnects said base plate and said feed plate for biasing said feed plate forward on said base plate to facilitate forward movement of said feed plate and said cutting plate on said base plate when said driving unit is activated.

* * * * *